US006925658B2

(12) United States Patent
Parker

(10) Patent No.: US 6,925,658 B2
(45) Date of Patent: Aug. 9, 2005

(54) LEAK PROOF TOILET TANK FLUSH VALVE

(75) Inventor: Peter Mario Parker, Baraboo, WI (US)

(73) Assignee: Peter M. Parker, Baraboo, WI (US)

( * ) Notice: Subject to any disclaimer, the term of this patent is extended or adjusted under 35 U.S.C. 154(b) by 47 days.

(21) Appl. No.: 10/259,674

(22) Filed: Sep. 30, 2002

(65) Prior Publication Data

US 2003/0233703 A1 Dec. 25, 2003

Related U.S. Application Data

(60) Provisional application No. 60/348,246, filed on Jan. 15, 2002, provisional application No. 60/327,946, filed on Oct. 10, 2001, and provisional application No. 60/324,367, filed on Sep. 24, 2001.

(51) Int. Cl.[7] ..... E03D 1/24

(52) U.S. Cl. ..... 4/391; 4/402

(58) Field of Search ..... 4/390, 391, 402, 4/397, 399

(56) References Cited

U.S. PATENT DOCUMENTS 2,066,796 A * 1/1937 Muller ..... 4/390
3,280,407 A * 10/1966 Aaron ..... 4/391

* cited by examiner

*Primary Examiner*—Robert M. Fetsuga

(57) ABSTRACT

A flush valve containing a flush drain entrance that while in a rest position is positioned above the water line so that there can be no leakage. When flushed, the entrance falls below the waterline, flushing the toilet bowl and then once again rises to a position above the waterline so that leakage cannot occur.

2 Claims, 4 Drawing Sheets

LEAK PROOF TOILET TANK FLUSH VALVE

This application refers to and claims benefit of previously filed provisional applications 60/324,367 filed Sep. 24, 2001 and 60/327,946 filed Oct. 10, 2001 and 60/348,246 filed Jan. 15, 2002.

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

A typical toilet tank like that found in most homes has a flush valve located on the inside bottom of the toilet tank. A flapper resting on top of the flush valve stops the flow of water through the flush valve and forms a somewhat watertight seal. When the toilet handle is pushed downwards, the flapper is lifted allowing water to flow through the flush valve, flushing the toilet. The method of sealing the flush valve with a flapper is common. At some point, the underside of the flapper and the top portion of the flush valve that are in contact and forms a somewhat watertight seal degenerates and begins to leak. Leaking begets leaking and after some time a considerable amount of water is being wasted and the flush valve and flapper must be replaced.

BRIEF SUMMARY OF THE INVENTION

The object of the present invention is to provide a leak proof flush valve that will retrofit existing toilet tanks as well as be able to be installed in new toilet tanks. The Leak Proof Toilet Tank Flush Valve comprises a toilet tank flush entrance that normally rests in a position above the waterline so water can never leak into the flush entrance. Only when the toilet is being flushed does the entrance momentarily fall below the waterline so the water can enter the entrance of the drain and flush the toilet.

An alternative design of the Leak Proof Toilet Tank Flush Valve incorporates the minimum number of components of the Leak Proof Toilet Tank Flush Valve necessary to operate the flush valve.

The invention is thus directed to a flush valve comprising:a flush basket having a drain aperture passing through it, the drain aperture having a peripheral edge; a side wall extending from the flush basket and encircling the peripheral edge of the drain aperture, the sidewall having at least one drain hole passing through it; a guide support connected to the side wall such that the guide support extends within or above drain aperture, the guide support having a guide hole passing through it and wherein the guide hole is disposed in registration with the drain aperture, and further wherein the guide support is a substantially C-shaped member having two arms, wherein the arms of the C-shaped member are connected to opposing points of the side wall; a guide rod having a first end and a second end, wherein one end of the guide rode is disposed within the guide hole of the guide support and is dimensioned and configured to slidingly pass through the guide hole; a flexible tube surrounding the guide rod, the flexible tube having a first end and a second end, wherein the first end of the flexible tubing is fastened about the first end of the guide rod, and the second end of the flexible tube is fastened about the side wall of the flush basket at a point removed from the at least one drain hole; and a flush lever dimensioned and configured to force an edge of the flush basket below the water line within a toilet tank. The invention may further comprise a clip frictionally and releasibly attached to the guide rod at a point proximate to the second end of the guide rod and abutting the guide support, and wherein the clip is dimensioned and configured to prevent the second end of the guide rod from being withdrawn from the guide hole.

DETAILED DESCRIPTION OF THE INVENTION

Figure 1:
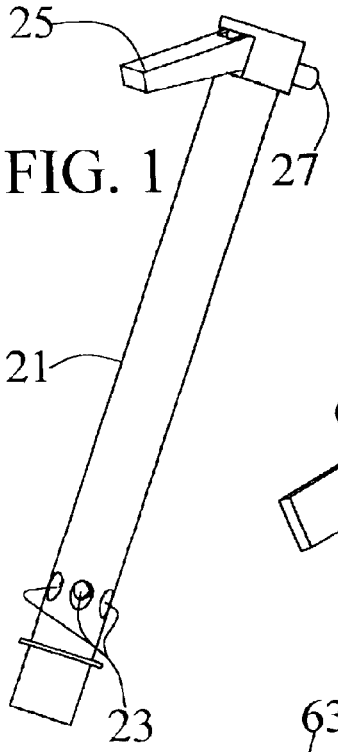
FIG. 1 is perspective view of the fill valve.

Referring to FIG. 1. The bottom threaded portion of fill valve 21 extends through a hole in the bottom of tank 2 and is first fastened to the tank 2 with a nut and then connected to a water supply. When the lever 25 is lifted upwards enough, the fill valve 21 is shut off. When the lever is slightly lowered as shown, the fill valve 21 is turned on and water flows into the tank 2 through tank fill holes 23 and into the bowl 4 through the bowl fill outlet 27 via a fill tube 31 (shown in FIG. 8).

Figure 2:
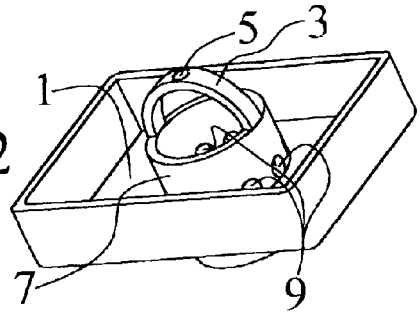
FIG. 2 is perspective view of the flush basket.

Referring to FIG. 2. The flush basket 1 having a drain 7 with side walls that extend both upwards and downwards through the base of flush basket 1 as shown. The top edge of the side walls of drain 7 are of sufficient height so that when the flush basket 1 is placed in a tank of water, the volume of water the flush basket 1 can hold without spilling over the upper edge of the side walls of drain 7 is sufficient in weight to sink the flush basket 1. Drain holes 9 are positioned around the base of the side walls of drain 7 as shown. A guide hole support 3 extends from the side walls of drain 7 as shown and has a guide hole 5 positioned on the guide hole support 3 as shown. The flush basket 1 is made from a plastic or rubber material or another material that will perform the functions outlined here.

Figure 3:
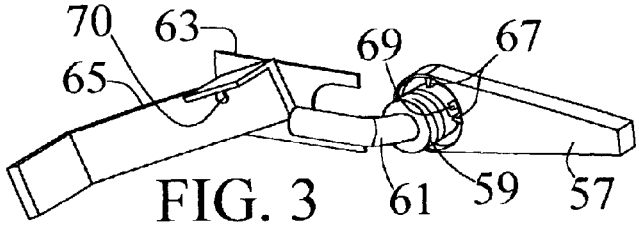
FIG. 3 is another perspective view of the partially assembled flush handle mechanism.
Figure 4:
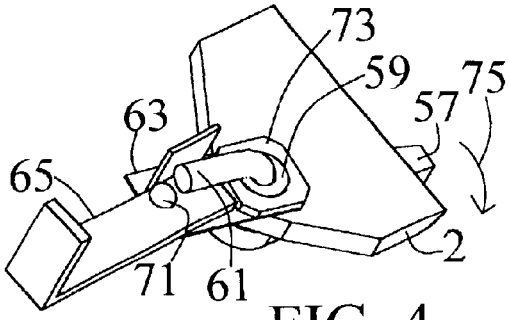
FIG. 4 is a perspective view of the flush handle mechanism mounted onto the tank.

Referring to FIG. 3 and FIG. 4. The handle 57 has a lever 61 extending from it as shown. A threaded cylinder 59 slips over the lever 61 so one end is flush or nearly flush with the base of the cavity in handle 57 as shown. Two stops 67 extend inwards from the walls of the cavity in handle 57 as shown. A stop edge 69 extends outward from the threaded cylinder 59 and is positioned between the two stops 67 as shown. When the threaded cylinder 59 is held in place, the handle 57 is free to rotate in both directions about the central axis of threaded cylinder 59 with the two stops 67 defining the outer limits of the rotation. A pivot plate 63 has a notch at one end for engaging the threaded cylinder 59. The flush lever 65 has a hole 70 that extends through flush lever 65 and pivot plate 63 and a pin 71 extending through hole 70 fastens the flush lever 65 and pivot plate 63 together so both can pivot about the central axis of pin 71. The lever 61 and threaded cylinder 59 extends from the outside of tank 2 through a hole in tank 2 that is designed to accept handles. The notch in pivot plate 63 then engages threaded cylinder 59 and a threaded nut 73 is fastened onto threaded cylinder 59 fastening the handle mechanism to the tank 2 as shown. The handle 57 is free to rotate in both directions about the central axis of threaded cylinder 59 within the defined limits of rotation as previously described. The pivot plate 63 is pinched between the threaded nut 73 and the inside surface of tank 2 and is fixed in place. When handle 57 is rotated in the direction indicated by arrow 75 about the central axis of threaded cylinder 59, lever 61 rotates in the same direction about the same axis pushing upwards on that portion of flush lever 65 that extends from one end of flush lever 65 as shown, causing flush lever 65 to rotate about pin 71 in the opposite direction as that indicated by arrow 75.

Figure 5:
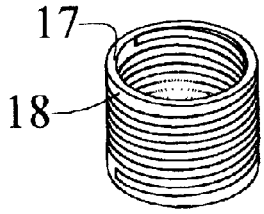
FIG. 5 is a perspective view of the flexible tubing.

Referring to FIG. 5, The skin 18 of flexible tubing 17 is made of a water-resistant material that maintains the physical properties necessary to perform well in water and temperatures and with chemicals that are typically used in this environment. The flexible tubing is designed to stretch to two or more times its relaxed state length.

Figure 6:
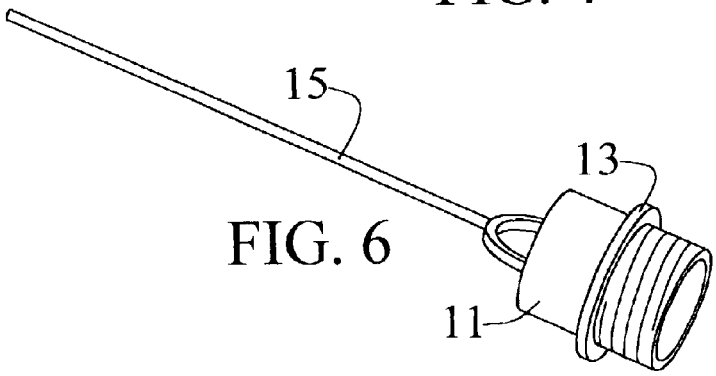
FIG. 6 is a perspective view of the flush drain.

Referring to FIG. 6. The bottom threaded portion of the flush drain 11 extends through a hole in the base of the tank 2 and is fastened to the tank 2 with a threaded nut. The guide rod 15 extends upwards. A gasket (not shown) is positioned between the flange 13 and the base of the tank 2 to form a watertight seal when the nut used to fasten the flush drain 11 to the tank 2 is tightened.

Figure 7:
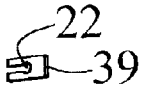
FIG. 7 is a perspective view of the clip.

Referring to FIG. 7. The diameter of hole 22 in the central portion of clip 39 is the same or slightly less than the diameter of the guide rod 15. When the clip 39 is pressed onto guide rod 15 until the central axis of hole 22 is lined up with the central axis of guide rod 15, the inside edges of clip 39 penetrate or grip the surface of guide rod 15 so the clip is held firmly in place.

Figure 8:
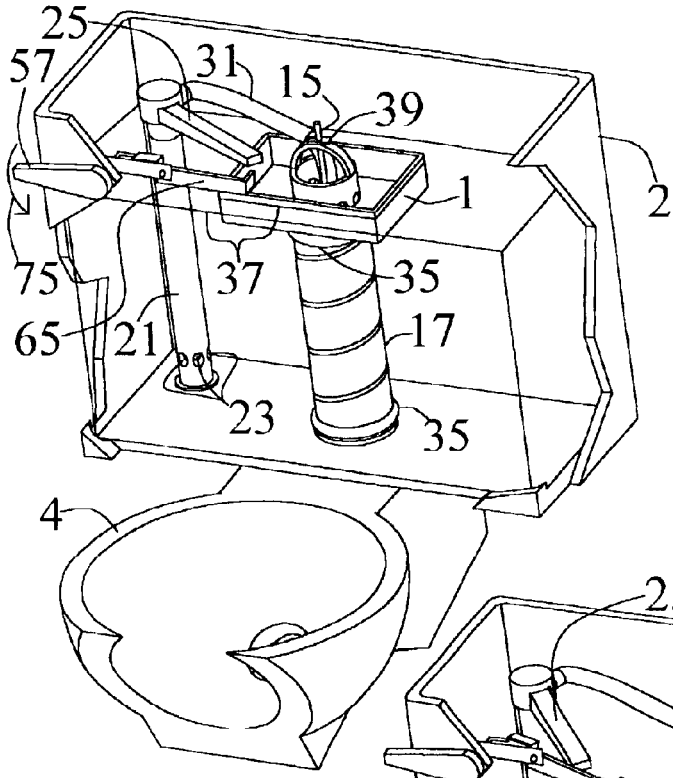
FIG. 8 is a perspective view of the assembled parts with the tank filled with water.

Referring to FIG. 8. Clip 39 is pressed onto guide rod 15 as previously described at a desired height. The buoyancy of flush basket 1 causes the upper edge of the side walls of flush basket 1 to push upwards on lever 25 far enough to turn off fill valve 21 as previously described. Fill tube 31 extends from the bowl fill outlet 27 and down drain 7 and the flexible tubing 17 so when the fill valve 21 is turned on, water will enter the toilet bowl 4. Guide hole 5 is shown engaging the guide rod 15, guiding the flush basket 1 on an up and down path. Rubber straps 35 is one of many methods that may be used to fasten one end of the flexible tubing 17 to the upper side walls of flush drain 11 and to fasten the other end of the flexible tubing 17 to the lower side walls of drain 7 as shown. Other methods may include using an adhesive or a strap or having one or more of these pieces molded as a single unit or using different welding or bonding methods or procedures or by using gaskets or seals.

One end of flush lever 65 is bent inwards as shown and is directly above the upper edge of flush basket 1 as shown. When handle 57 is rotated in the direction indicated by arrow 75 flush lever 65 rotates in the opposite direction as previously described, pushing downwards on the upper edge of flush basket 1 and dunking the upper edge of flush basket 1 beneath the water surface 37 so that the flush basket begins to take in water. The drain holes 9 more clearly shown in FIG. 2 are sized so that the water entering the flush basket 1 when it is dunked, enters faster than water can drain through drain holes 9 so that the flush basket 1 eventually fills with water and sinks. Water can then enter drain 7 and flexible tubing 17 and flush drain 11, flushing the toilet. Lever 25 falls downward turning on fill valve 21 when the flush basket 1 sinks.

Figure 9:
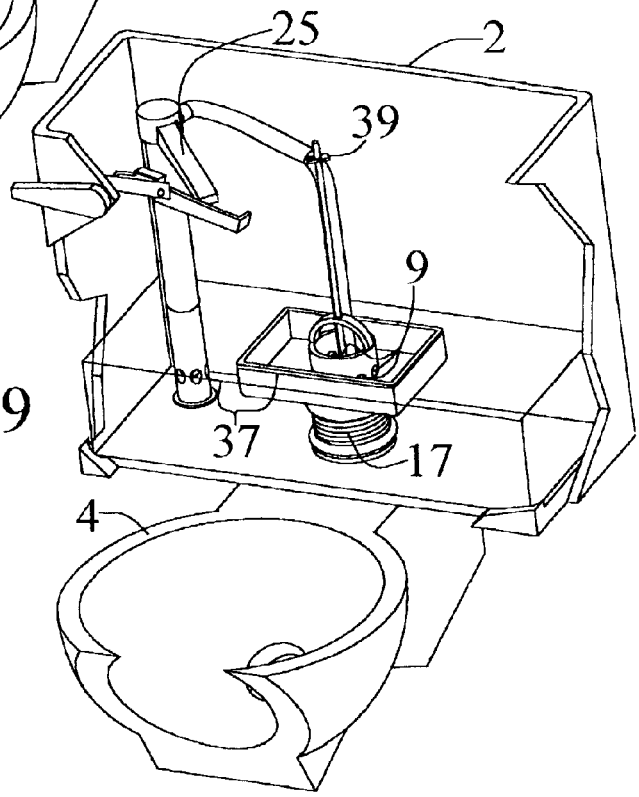
FIG. 9 is a perspective view of the assembled parts during the flush cycle.

Referring to FIG. 9. The flexible tubing 17 has collapsed as far as it can and the flush basket 1 is resting on top of the flexible tubing 17. The water has drained until the surface of the water 37 has reached the upper edge of the side walls of the flush basket 1 as shown. The remaining water in the flush basket 1 has drained out through drain holes 9. Lever 25 is still in a downward position so that water is still filling the tank 2 and bowl 4 as previously described. When the water within flush basket 1 is sufficiently drained, the flush basket 1 will rise with the water surface 37 until the upper edge of flush basket 1 pushes lever 25 upwards far enough to turn off fill valve 21, ending the flush cycle.

Figure 10:
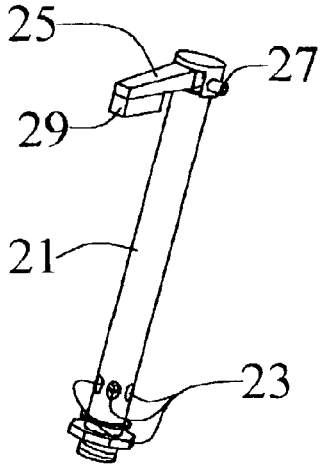
FIG. 10 is perspective view of the alternative fill valve.

FIG. 10 shows a fill valve 21. Its bottom threaded portion extends through a hole in the bottom of the toilet tank and is first fastened to the tank with a nut and then connected to a water supply. When the lever 25 is lifted upwards enough as shown, the fill valve 21 is shut off. When the lever is slightly lowered, the fill valve 21 is turned on and water flows into the tank through tank fill holes 23 and into the toilet bowl through the bowl fill outlet 27 via a fill tube 31 (shown in FIGS. 5 and 6)as will be well understood to those familiar with this art. A float 29 is attached to the end of lever 25 as shown.

Figure 11:
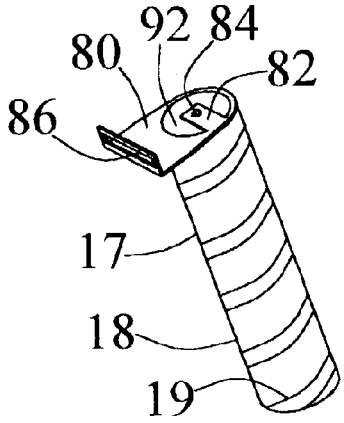
FIG. 11 is perspective view of the alternative flexible tubing.

FIG. 11 shows flexible tubing 17. The skin 18 of flexible tubing 17 is made of a water-resistant material that maintains the physical properties necessary to perform well in water and temperatures and with chemicals that are typically used in this environment. Within this skin 18 there may be a flexible support 19 that provides the flexible tubing 17 with the strength necessary to keep the skin 18 from caving in on itself and to perform well under these conditions. A plate 80 is attached to the flexible tubing 17 at one end near it's mouth and has a bend at its other end that has a channel 86 from near one end of the bend to near the other end of the bend as shown. An extension 82 extends inwards from the mouth of the flexible tubing 17 as shown and a guide hole 84 is positioned near the end of extension 82 as shown. The drain entrance 92 is at the mouth of the flexible tubing 17 as shown.

Figure 12:
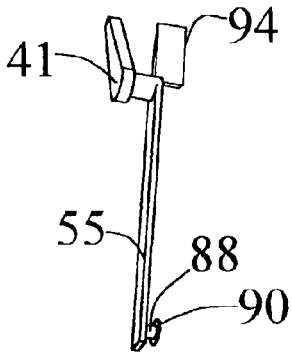
FIG. 12 is perspective view of the alternative flush handle.

FIG. 12 shows flush handle 41 having an extension 55. At one end of extension 55 there is a pin 88 extending outwards as shown. A removable cap 90 is place on the end of pin 88 as shown. A counter weight 94 is located on flush handle 41 near one end of extension 55 as shown.

Figure 13:
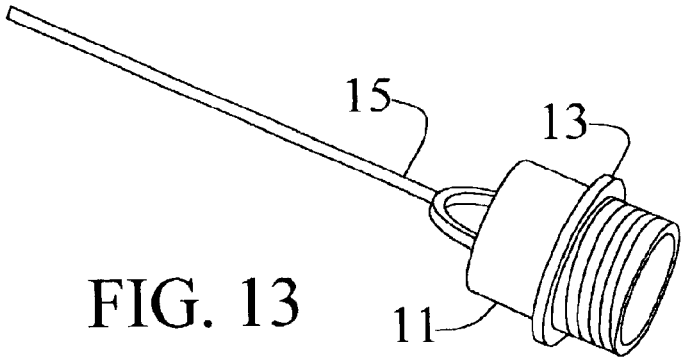
FIG. 13 is perspective view of the alternative flush drain.

FIG. 13 shows the flush drain 11. The bottom threaded portion of the flush drain 11 extends through a hole (having a diameter slightly greater than the threaded portion of the flush drain 11) in the bottom of the toilet tank and is fastened to the tank with a nut. The guide rod 15 extends upwards from the flush drain 11. A gasket (not shown) is positioned between the flange 13 and the base of the tank to form a watertight seal when the nut used to fasten the flush drain 11 to the tank is tightened.

Figure 14:
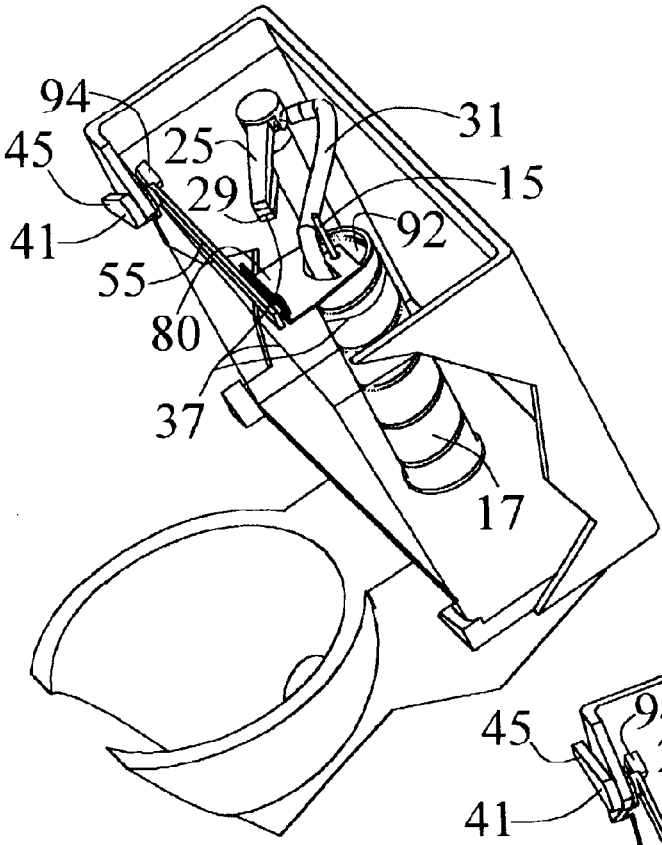
FIG. 14 is perspective view of all the alternative assembled parts.

FIG. 14 and 6 show the assembled parts comprising the invention. The flush handle 41 is inserted into a hole in the tank designed for that purpose and fastened with a nut from the inside of the tank. The extension 55 of flush handle 41 extends towards plate 80 with the pin 88 inserted into channel 86 and the cap 90 inserted onto pin 88 to fasten pin 88 into channel 86. The flexible tubing 17 is fastened to the neck of flush drain 11 at one end and has the drain entrance 92 at its other end as shown.

In FIG. 14 the toilet tank is full of water and the water surface 37 forces float 29 upwards holding lever 25 upwards keeping fill valve 21 in an off position as previously described. When the end 45 of handle 41 is pulled upwards extension 55 moves downwards forcing the drain entrance 92 downwards below the water surface 37 allowing water to exit the toilet tank and the toilet flushes as will be well understood to those familiar with this art. The guide rod 15 is engaged with the guide hole 84 guiding the path as the drain entrance moves up and down in a straight path. As the extension 55 moves in a downwards arc, the drain entrance move an a straight downwards path. The pin 88 slides through channel 86 so there is no binding between the pin 88 and channel 86 and the guide hole 84 and guide rod 15.

Figure 15:
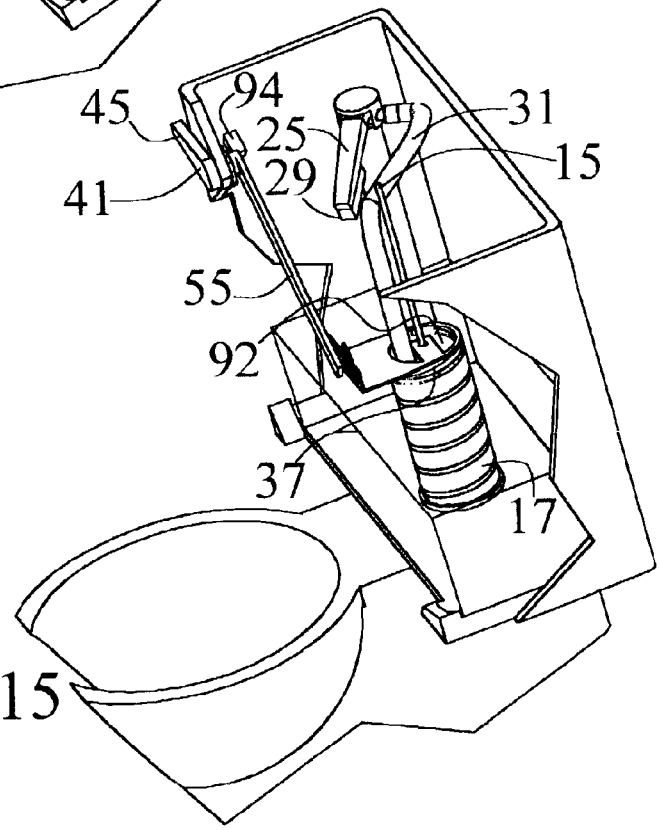
FIG. 15 is perspective view of the alternative assembled parts during the flush cycle.

In FIG. 15, all the water that was previously above the drain entrance 92 has drained through drain entrance 92 and out of the toilet tank. The lever 25 has fallen and turned on fill valve 21 as previously described so that water is entering the toilet tank and toilet bowl as previously described. The end 45 of the handle 41 can now be pushed downwards so extension 55 moves upwards raising the drain entrance 92 above the water surface 37. The toilet tank can now fill with water until the water surface 37 rises sufficiently to force the float 29 and lever 25 upwards far enough to turn off fill valve 21, ending the cycle. The counter weight 94 holds the end 45 of handle 41 downwards so the drain entrance 92 is held above the water surface 37 in the position shown in FIG. 14 until the next flush.

I claim:

1. A flush valve comprising:

a flush basket having a drain aperture passing through it, the drain aperture having a peripheral edge;

a side wall extending from the flush basket and encircling the peripheral edge of the drain aperture, the sidewall having at least one drain hole passing through it;

a guide support connected to the side wall such that the guide support extends within or above drain aperture, the guide support having a guide hole passing through it and wherein the guide hole is disposed in registration with the drain aperture, and further wherein the guide support is a substantially C-shaped member having two arms, wherein the arms of the C-shaped member are connected to opposing points of the side wall;

a guide rod having a first end and a second end, wherein one end of the guide rod is disposed within the guide hole of the guide support and is dimensioned and configured to slidingly pass through the guide hole;

a flexible tube surrounding the guide rod, the flexible tube having a first end and a second end, wherein the first end of the flexible tubing is fastened about the first end of the guide rod, and the second end of the flexible tube is fastened about the side wall of the flush basket at a point removed from the at least one drain hole; and a flush lever dimensioned and configured to force an edge of the flush basket below the water line within a toilet tank.

2. The flush valve of claim 1, further comprising a clip frictionally and releasibly attached to the guide rod at a point proximate to the second end of the guide rod and abutting the guide support, and wherein the clip is dimensioned and configured to prevent the second end of the guide rod from being withdrawn from the guide hole.

* * * * *